US010083607B2

(12) United States Patent
Ginsberg et al.

(10) Patent No.: US 10,083,607 B2
(45) Date of Patent: Sep. 25, 2018

(54) DRIVER SAFETY ENHANCEMENT USING INTELLIGENT TRAFFIC SIGNALS AND GPS

(75) Inventors: Matthew L. Ginsberg, Eugene, OR (US); Pamela D. Kinion, Eugene, OR (US); Stewart L. Mones, Eugene, OR (US)

(73) Assignee: Green Driver, Inc., Eugene, OR (US)

( * ) Notice: Subject to any disclaimer, the term of this patent is extended or adjusted under 35 U.S.C. 154(b) by 610 days.

(21) Appl. No.: 13/542,938

(22) Filed: Jul. 6, 2012

(65) Prior Publication Data

US 2012/0274481 A1 Nov. 1, 2012

Related U.S. Application Data

(63) Continuation-in-part of application No. 13/352,013, filed on Jan. 17, 2012, which is a continuation-in-part of application No. 12/886,100, filed on Sep. 20, 2010, which is a continuation-in-part of application No. 12/821,349, filed on Jun. 23, 2010, which is a continuation-in-part of application No. 12/639,770, filed on Dec. 16, 2009, application No. 13/542,938, (Continued)

(51) Int. Cl.

| | |
|---|---|
| ***G08G 1/0968*** | (2006.01) |
| ***G08G 1/0967*** | (2006.01) |
| ***G08G 1/081*** | (2006.01) |

(52) U.S. Cl.

CPC ..... *G08G 1/096883* (2013.01); *G08G 1/081* (2013.01); *G08G 1/096775* (2013.01)

(58) Field of Classification Search

CPC ..... G08G 1/096775; G08G 1/096883; G08G 1/081; G08G 1/082; G08G 1/08; G08G 1/017; G08G 1/04; G08G 1/096716; G08G 1/096783; G08G 1/09675; G08G 1/096758

USPC ..... 340/910, 905, 435, 438, 601; 701/14.4, 701/14.49; 705/117, 200, 204, 301, 532

See application file for complete search history.

(56) References Cited

U.S. PATENT DOCUMENTS

| | | | |
|---|---|---|---|
| 4,713,767 | A | 12/1987 | Sato et al. |
| 4,731,613 | A | 3/1988 | Endo et al. |

(Continued)

FOREIGN PATENT DOCUMENTS

| | | | |
|---|---|---|---|
| CN | 101093168 | A | 12/2007 |
| CN | 101118559 | A | 2/2008 |

(Continued)

OTHER PUBLICATIONS

European Patent Office, Supplementary European Search Report and Opinion, European Patent Application No. 10808489.8, dated Feb. 22, 2013, nine pages.

(Continued)

*Primary Examiner* — Sisay Yacob

(74) *Attorney, Agent, or Firm* — Fenwick & West LLP

(57) ABSTRACT

A safety system determines a correspondence between a vehicle and an upcoming traffic signal, and predicts a state of the traffic signal when the vehicle is expected to reach the signal's location. Based on proximity to the signal and speed of the vehicle, the system provides a warning if it determines that the vehicle is likely to proceed contrary to the signal (e.g., a driver is likely to run a red light). The warning is issued to the vehicle about to illegally enter the intersection, to other nearby vehicles and pedestrians, and to the traffic signal itself.

2 Claims, 8 Drawing Sheets

Related U.S. Application Data which is a continuation-in-part of application No. 13/425,707, filed on Mar. 21, 2012, which is a continuation-in-part of application No. 11/851,953, filed on Sep. 7, 2007.

(60) Provisional application No. 61/233,123, filed on Aug. 11, 2009.

(56) References Cited

U.S. PATENT DOCUMENTS 4,882,689 A 11/1989 Aoki
4,903,212 A 2/1990 Yokouchi et al.
4,926,336 A 5/1990 Yamada
4,994,971 A 2/1991 Poelstra
5,060,162 A 10/1991 Ueyama et al.
5,087,919 A 2/1992 Odagawa et al.
5,155,688 A 10/1992 Tanaka et al.
5,179,519 A 1/1993 Adachi et al.
5,272,483 A 12/1993 Kato
5,272,638 A 12/1993 Martin et al.
5,307,277 A 4/1994 Hirano
5,313,200 A 5/1994 Sone
5,374,933 A 12/1994 Kao
5,383,127 A 1/1995 Shibata
5,390,125 A 2/1995 Sennott et al.
5,416,712 A 5/1995 Geier et al.
5,442,559 A 8/1995 Kuwahara et al.
5,469,158 A 11/1995 Morita
5,469,360 A 11/1995 Ihara et al.
5,485,161 A 1/1996 Vaughn
5,488,559 A 1/1996 Seymour
5,493,291 A 2/1996 Bruggemann
5,504,482 A 4/1996 Schreder
5,523,765 A 6/1996 Ichikawa
5,530,651 A 6/1996 Uemura et al.
5,537,323 A 7/1996 Schulte
5,546,311 A 8/1996 Sekine
5,552,990 A 9/1996 Ihara et al.
5,608,391 A 3/1997 Bantli et al.
5,689,423 A 11/1997 Sawada
5,699,056 A 12/1997 Yoshida
5,739,772 A 4/1998 Nanba et al.
5,740,049 A 4/1998 Kaise
5,742,923 A 4/1998 Odagawa
5,771,484 A 6/1998 Tognazzini
5,774,824 A 6/1998 Streit et al.
5,821,880 A 10/1998 Morimoto et al.
5,831,551 A 11/1998 Geduld
5,839,087 A 11/1998 Sato
5,847,661 A 12/1998 Ricci
5,848,373 A 12/1998 Delorme et al.
5,852,791 A 12/1998 Sato et al.
5,862,511 A 1/1999 Croyle et al.
5,890,682 A 4/1999 Welk
5,910,789 A 6/1999 Vigen
5,925,090 A 7/1999 Poonsaengsathit
5,940,010 A * 8/1999 Sasaki et al. ..... 340/901
5,941,934 A 8/1999 Sato
5,948,042 A 9/1999 Heimann et al.
5,949,375 A 9/1999 Ishiguro et al.
5,951,620 A 9/1999 Ahrens et al.
5,959,577 A 9/1999 Fan et al.
5,982,298 A 11/1999 Lappenbusch et al.
5,987,378 A 11/1999 Schipper et al.
5,999,878 A 12/1999 Hanson et al.
6,008,740 A 12/1999 Hopkins
6,035,253 A 3/2000 Hayashi et al.
6,047,234 A 4/2000 Cherveny et al.
6,049,303 A 4/2000 Biacs et al.
6,057,785 A 5/2000 Guthrie
6,067,502 A 5/2000 Hayashida et al.
6,078,865 A 6/2000 Koyanagi
6,084,543 A 7/2000 Iizuka
6,122,593 A 9/2000 Friederich et al.
6,144,916 A 11/2000 Wood et al.
6,150,961 A 11/2000 Alewine et al.
6,151,550 A 11/2000 Nakatani
6,173,232 B1 1/2001 Nanba et al.
6,240,364 B1 5/2001 Kerner et al.
6,246,948 B1 6/2001 Thakker
6,252,544 B1 6/2001 Hoffberg
6,253,150 B1 6/2001 Nakamura
6,269,303 B1 7/2001 Watanabe et al.
6,285,875 B1 9/2001 Alajoki et al.
6,298,302 B2 10/2001 Walgers et al.
6,317,058 B1 11/2001 Lemelson et al.
6,317,685 B1 11/2001 Kozak et al.
6,317,686 B1 11/2001 Ran
6,333,703 B1 12/2001 Alewine et al.
6,338,021 B1 1/2002 Yagyu et al.
6,343,301 B1 1/2002 Halt et al.
6,351,709 B2 2/2002 King et al.
6,353,785 B1 3/2002 Shuman et al.
6,353,796 B1 3/2002 Schipper et al.
6,356,839 B1 3/2002 Monde et al.
6,360,165 B1 3/2002 Chowdhary
6,381,533 B1 4/2002 Crane et al.
6,466,862 B1 10/2002 DeKock et al.
6,472,977 B1 10/2002 Pöchmüller
6,515,596 B2 2/2003 Awada
6,516,267 B1 2/2003 Cherveny et al.
6,516,273 B1 2/2003 Pierowicz et al.
6,526,352 B1 2/2003 Breed et al.
6,535,140 B1 3/2003 Goss et al.
6,539,300 B2 3/2003 Myr
6,553,308 B1 4/2003 Uhlmann et al.
6,574,550 B2 6/2003 Hashida
6,577,946 B2 6/2003 Myr
6,615,135 B2 9/2003 Davies
6,621,420 B1 9/2003 Poursartip
6,633,238 B2 10/2003 Lemelson et al.
6,675,085 B2 1/2004 Straub
6,708,085 B2 3/2004 Yamane et al.
6,708,107 B2 3/2004 Impson et al.
6,711,493 B1 3/2004 Andrews et al.
6,741,933 B1 5/2004 Glass
6,751,549 B1 6/2004 Kozak
6,785,606 B2 8/2004 DeKock et al.
6,801,638 B1 10/2004 Janssen et al.
6,801,850 B1 10/2004 Wolfson
6,850,841 B1 2/2005 Casino
6,853,913 B2 2/2005 Cherveny et al.
6,882,930 B2 4/2005 Trayford et al.
6,931,322 B2 8/2005 Jung et al.
6,941,220 B2 9/2005 Le et al.
6,941,221 B2 9/2005 Draeger et al.
6,989,766 B2 1/2006 Mese et al.
6,992,598 B2 1/2006 Poltorak
7,053,780 B1 5/2006 Straub et al.
7,079,946 B2 7/2006 Hunzinger
7,162,367 B2 1/2007 Lin et al.
7,239,962 B2 7/2007 Plutowski
7,366,606 B2 4/2008 Uyeki
7,382,274 B1 6/2008 Kermani et al.
7,432,826 B2 10/2008 Schwartz
7,433,889 B1 10/2008 Barton
7,466,227 B2 * 12/2008 Chen et al. ..... 340/539.13
7,477,984 B2 1/2009 Zhang et al.
7,522,940 B2 4/2009 Jendbro et al.
7,589,643 B2 9/2009 Dagci et al.
7,680,588 B2 3/2010 Tsukamoto
7,818,116 B1 10/2010 Nesbitt
7,912,637 B2 3/2011 Horvitz et al.
RE42,807 E 10/2011 Harris
8,102,253 B1 1/2012 Brady, Jr.
8,427,303 B1 4/2013 Brady, Jr. et al.
8,576,069 B2 11/2013 Nadeem et al.
2001/0001848 A1 5/2001 Oshizawa et al.
2001/0020213 A1 9/2001 Hatano
2001/0029425 A1 10/2001 Myr
2001/0050620 A1 12/2001 Lee

(56) References Cited

U.S. PATENT DOCUMENTS

| | | | | |
|---|---|---|---|---|
| 2002/0067289 | A1* | 6/2002 | Smith | 340/905 |
| 2002/0120390 | A1 | 8/2002 | Bullock | |
| 2002/0126023 | A1 | 9/2002 | Awada | |
| 2003/0060977 | A1 | 3/2003 | Jijina et al. | |
| 2003/0069683 | A1 | 4/2003 | Lapidot et al. | |
| 2003/0078720 | A1 | 4/2003 | Adachi | |
| 2003/0128135 | A1* | 7/2003 | Poltorak | 340/906 |
| 2003/0191568 | A1 | 10/2003 | Breed | |
| 2004/0030670 | A1 | 2/2004 | Barton | |
| 2004/0130442 | A1 | 7/2004 | Breed et al. | |
| 2004/0189489 | A1* | 9/2004 | Terui | 340/901 |
| 2004/0267440 | A1 | 12/2004 | DeKock et al. | |
| 2005/0149259 | A1 | 7/2005 | Cherveny et al. | |
| 2005/0187701 | A1* | 8/2005 | Baney | 701/117 |
| 2005/0227696 | A1 | 10/2005 | Kaplan et al. | |
| 2005/0283312 | A1 | 12/2005 | Taliwal | |
| 2006/0095199 | A1 | 5/2006 | Lagassey | |
| 2006/0265294 | A1* | 11/2006 | de Sylva | 705/28 |
| 2006/0282214 | A1 | 12/2006 | Wolterman | |
| 2006/0293852 | A1 | 12/2006 | Tsurumi | |
| 2007/0001830 | A1 | 1/2007 | Dagci et al. | |
| 2007/0005240 | A1 | 1/2007 | Oumi et al. | |
| 2007/0010942 | A1 | 1/2007 | Bill | |
| 2007/0021905 | A1 | 1/2007 | Takashima | |
| 2007/0027583 | A1 | 2/2007 | Tamir et al. | |
| 2007/0038362 | A1 | 2/2007 | Gueziec | |
| 2007/0103341 | A1 | 5/2007 | Kreiner et al. | |
| 2007/0208492 | A1 | 9/2007 | Downs et al. | |
| 2007/0222638 | A1 | 9/2007 | Chen et al. | |
| 2007/0225912 | A1 | 9/2007 | Grush | |
| 2007/0270120 | A1* | 11/2007 | Zhang et al. | 455/344 |
| 2008/0004789 | A1 | 1/2008 | Horvitz et al. | |
| 2008/0082251 | A1 | 4/2008 | Ishikawa et al. | |
| 2008/0094250 | A1 | 4/2008 | Myr | |
| 2008/0180281 | A1 | 7/2008 | Bilimoria et al. | |
| 2008/0218380 | A1 | 9/2008 | Wall et al. | |
| 2008/0249713 | A1 | 10/2008 | Sessions | |
| 2008/0275629 | A1 | 11/2008 | Yun | |
| 2009/0005984 | A1 | 1/2009 | Bradley | |
| 2009/0070031 | A1 | 3/2009 | Ginsberg | |
| 2009/0088965 | A1 | 4/2009 | Burckart et al. | |
| 2009/0138187 | A1 | 5/2009 | Mathias | |
| 2009/0138189 | A1 | 5/2009 | Kim et al. | |
| 2010/0094583 | A1 | 4/2010 | Borean et al. | |
| 2010/0145569 | A1 | 6/2010 | Bourque et al. | |
| 2010/0171640 | A1* | 7/2010 | Delia et al. | 340/907 |
| 2011/0037618 | A1 | 2/2011 | Ginsberg et al. | |
| 2011/0037619 | A1 | 2/2011 | Ginsberg et al. | |
| 2011/0040621 | A1 | 2/2011 | Ginsberg et al. | |
| 2012/0274481 | A1 | 11/2012 | Ginsberg et al. | |
| 2013/0166109 | A1 | 6/2013 | Ginsberg | |

FOREIGN PATENT DOCUMENTS

| | | | |
|---|---|---|---|
| EP | 1 288 883 | | 3/2003 |
| JP | 08-269921 | A | 10/1996 |
| JP | 2009245326 | A * | 10/2009 |
| WO | WO 2005/019000 | | 3/2005 |

OTHER PUBLICATIONS

PCT International Search Report and Written Opinion, PCT Application No. PCT/US2013/21235, dated Feb. 1, 2013, ten pages.

Aoude, G. et al., "Behavior Classification Algorithms at Intersections and Validation using Naturalistic Data," Jul. 2011, six pp.. [Online] [Retrieved Jun. 5, 2012] Retrieved from the Internet <Url:http://act mitedu/papers/IV11AoudeDesarajuLaurensHow.pdf.>.

Faezipour, M. et al., "Progress and Challenges in Intelligent Vehicle Area Networks," Communications of the Acm, Feb. 2012, pp. 90-100, vol. 55, No. 2.

Gminsidenews.Com, "Dcs Preps Safety System to Prevent Red-Light Running," Jun. 18, 2006, eleven pp.. [Online] [Retrieved Jan. 23, 2012] Retrieved from the Internet <Url:http://www.gminsidenews.comfforums/f58/dcx-preps-safety-system-prevent-red-light-running-32921/.>.

Inman, V. et al., "The Effects of In-Vehicle and Infrastructure-Based Collision Warning at Signalized Intersections," Federal Highway Administration (Fhwa), Publication No. Fhwa-Hrt-09-049, Dec. 2009, forty-six pp.. [Online] [Retrieved Jan. 23, 2012] Retrieved from the Internet <Url:http://www.fhwa.dot.gov/publications/research/safety/09049/09049.pdf.>.

Intelligent Transportation Society of America, "Transportation, Rebirth!: Migration to Vehicle Infrastructure Integration (Vii)," Vii Technology Showcase and Its America Vii Initiative Outreach Program, Date Unknown, twenty-seven pp.. [Online] [Retrieved Jan. 23, 2012] Retrieved from the Internet <Url:http://fortworth.texite.org/Site.Files/TexITE%20presentationMay07.pdf.>.

Intellione Technologies Corp., "io-locate: Strike While the Customer is Near," 2009 [Online] [Retrieved Aug. 16, 2010] Retrieved from the Internet Url:http://www.intellione.com/ioLocate.html>.

Intellione Technologies Corp., "io-traffic: Traffic Data at the Speed of Business," 2008 [Online] [Retrieved Aug. 16, 2010] Retrieved from the Internet Url:http://www.intellione.com/io-traffic_information_sheet.pdf>.

Intellione Technologies Corp., "io-vector: Beat Traffic at Its Own Game," 2008 [Online] [Retrieved Aug. 16, 2010] Retrieved from the Internet Url:http://www.intellione.com/io-vector_information_sheet.pdf>.

Maile, M. et al., "Cooperative Intersection Collision Avoidance System for Violations (Cicas-V) for Avoidance of Violation-Based Intersection Crashes," Mercedes-Benz Research & Development North America, Inc., Usa, Paper No. Sep. 0118, 2009, fourteen pp.. [Online] [Retrieved Jun. 5, 2012] Retrieved from the Internet <Url:http://www-nrd.nhtsa.dot.gov/pdf/esv/esv21/Sep. 0118.pdf.>.

PCT International Search Report and Written Opinion, PCT Application No. PCT/US2011/040279, Oct. 13, 2011, six pages.

PCT International Search Report and Written Opinion, PCT Application No. PCT/US2010/038863, Aug. 17, 2010, 10 pp.

Strauss, S. "Traffic Magic," University Affairs, Dec. 7, 2009 [Online] [Retrieved Aug. 17, 2010] Retrieved from the Internet Url:http://www.universityaffairs.ca/Print.aspx?id=7102>.

United States Patent and Trademark Office, Non-Final Rejection, United States Patent Application No. 12/821,349, Nov. 2, 2012, 17 pp.

United States Patent and Trademark Office, Non-Final Rejection, United States Patent Application No. 12/639,770, Oct. 24, 2012, 31 pp.

United States Patent and Trademark Office, Non-Final Rejection, United States Patent Application No. 12/886,100, Dec. 31, 2012, 15 pp.

United States Patent and Trademark Office, Non-Final Rejection, United States Patent Application No. 13/372,391, Dec. 18, 2012, 17 pp.

United States Patent and Trademark Office, Non-Final Rejection, United States Patent Application No. 13/352,013, Dec. 17, 2012, 21 pp.

United States Patent and Trademark Office, Non-Final Rejection, United States U.S. Appl. No. 13/542,938, dated Dec. 28, 2012, 30 Pages.

Australian Government, IP Australian, Patent Examination Report No. 1, Australian Patent Application No. 2010282926, dated Nov. 28, 2013, three pages.

European Patent Office, Examination Report, European Patent Application No. 10808489.8, dated Nov. 14, 2013, five pages.

State Intellectual Property Office of the People's Republic of China, First Office Action, Chinese Patent Application No. 201080043533.8, dated Nov. 27, 2013, forty-seven pages.

Taiwan Intellectual Property Office, Office Action, Taiwan Patent Application No. 100121872, dated Sep. 16, 2013, fourteen pages.

United States Office Action, U.S. Appl. No. 12/639,770, dated Oct. 23, 2013, thirty pages.

United States Office Action, U.S. Appl. No. 12/821,349, dated Oct. 23, 2013, twenty-six pages.

(56) References Cited

OTHER PUBLICATIONS

United States Office Action, U.S. Appl. No. 12/886,100, dated Oct. 15, 2013, twelve pages.
United States Office Action, U.S. Appl. No. 13/425,707, dated Jan. 22, 2014, ten pages.
United States Office Action, U.S. Appl. No. 13/352,013, dated Oct. 23, 2013, thirteen pages.
United States Office Action, U.S. Appl. No. 13/372,391, dated Dec. 30, 2013, seventeen pages.
United States Office Action, U.S. Appl. No. 13/772,941, dated Jan. 31, 2014, twenty-four pages.
United States Office Action, U.S. Appl. No. 12/821,349, dated Jun. 20, 2013, twenty-three pages.
United States Office Action, U.S. Appl. No. 13/352,013, dated Jun. 21, 2013, twenty-one pages.
United States Office Action, U.S. Appl. No. 13/372,391, dated Jul. 8, 2013, nineteen pages.
United States Office Action, U.S. Appl. No. 13/772,941, dated Jul. 22, 2013, sixteen pages.
United States Office Action, U.S. Appl. No. 13/747,145, dated Jun. 5, 2014, thirteen pages.

* cited by examiner

DRIVER SAFETY ENHANCEMENT USING INTELLIGENT TRAFFIC SIGNALS AND GPS

RELATED APPLICATIONS

This application is a continuation in part of co-pending U.S. patent application Ser. No. 13/352,013, filed Jan. 17, 2012, entitled "Driver Safety Enhancement Using Intelligent Traffic Signals and GPS", which is a continuation in part of co-pending U.S. patent application Ser. No. 12/886,100, filed Sep. 20, 2010, entitled "Driver Safety System Using Machine Learning", which is a continuation in part of U.S. patent application Ser. No. 12/821,349, filed Jun. 23, 2010, entitled "Traffic Routing Display System", which is a continuation in part of U.S. patent application Ser. No. 12/639,770, filed Dec. 16, 2009, entitled "Traffic Routing Using Intelligent Traffic Signals, GPS And Mobile Data Devices" which claims priority pursuant to 35 U.S.C. § 120 upon U.S. Provisional Patent Application No. 61/233,123 filed Aug. 11, 2009, all of which are incorporated herein by reference as if fully set forth herein. This application is also a continuation in part of co-pending U.S. patent application Ser. No. 13/425,707, filed Mar. 21, 2012, entitled "System and Method for Automated Updating of Map Information", which is a continuation in part of co-pending U.S. patent application Ser. No. 11/851,953, filed Sep. 7, 2007, entitled "System and Method for Automated Updating of Map Information", both of which are incorporated herein by reference as if fully set forth herein.

FIELD OF INVENTION

The present invention relates generally to traffic control, routing and safety systems.

BACKGROUND

Significant reductions in vehicle emissions can be achieved, congestion can be limited, safety can be enhanced and travel times reduced by integrating diverse technology in the vehicular transportation domain. Numerous schemes have been proposed in the past for informing drivers of traffic conditions and presenting them with proposed alternatives when congestion is found. For example, traffic helicopters have been used for decades by radio stations to spot areas of congestion and suggest alternate paths that drivers may wish to consider.

With the growing popularity of GPS and hand-held computing devices, particularly those connected to cellular networks or the internet, other approaches have been used, such as graphical representations of maps with routes being color-coded to indicate levels of congestion.

Another approach to the traffic congestion problem involves "smart" traffic signals. For instance, railroad crossings have for decades been tied to traffic signals to help ease the flow of traffic on routes adjacent to railroad crossings when a train approaches. Further, certain systems have been installed that allow emergency vehicles such as fire trucks to change the state of a light from red to green so that the emergency vehicle can cross the intersection quickly with, rather than against, the signal.

In still another related area, various attempts have been made to collect traffic information from drivers who have, for example, GPS-enabled smartphones with them in their vehicles. Typically, such drivers do not find sufficient incentive to start up, and keep running, an application that will transmit their speed and location information to a remote traffic database.

Systems are emerging that take advantage of the integration of technologies that are available to report traffic information to drivers and suggest routes based on that information, to communicate with traffic signals, and to collect traffic information from drivers. For example, a project known as the Cooperative Intersection Collision Avoidance system for Violations (CICAS-V) sought to predict stop sign and traffic signal violations and warn the driver of the impending problem. See, e.g., Cooperative Intersection Collision Avoidance System for Violations (CICAS-V) for Avoidance of Violation-Based Intersection Crashes, Michael Maile and Luca Delgrossi (Mercedes-Benz Research & Development North America, Inc.), Paper Number 09-0118, downloaded from http://www-nrd.nhtsa.dot.gov/pdf/esv/esv21/09-0118.pdf for an exemplary research report from this project. As a follow-up to that work, research has been conducted into optimal timing for prediction of such intersection violations and for issuing warnings relating to same. See, e.g., Behavior Classification Algorithms at Intersections and Validation using Naturalistic Data, George Aoude, Vishnu Desaraju, Lauren Stephens and Jonathan How (Massachusetts Institute of Technology), presented at Intelligent Vehicles Symposium, June 2011 and downloaded from http://acl.mit.edu/papers/IV11AoudeDesarajuLaurensHow.pdf. These approaches are helpful, but rely on a level of direct communication among various infrastructure elements (traffic signals, vehicles, pedestrians) that may not be available for a number of years at many intersections.

In one particular area addressed by this disclosure, it would be advantageous to provide a system that minimizes reliance on infrastructure communications yet still enhances safety by, for instance, warning drivers and pedestrians automatically when a vehicle's current course and speed suggest that it is going to pass a traffic control illegally (e.g., go through an intersection when a traffic light is red).

SUMMARY OF THE DISCLOSURE

A safety enhancement system includes a system for determining when a driver is about to run a red light and for warning the driver, drivers of other vehicles and pedestrians of the danger. The information presented in the driver's vehicle optionally includes a traffic routing display system includes a destination display, a routing display, and a settings display. The display system is used in conjunction with a routing system providing communications among vehicles and traffic controls, such as traffic lights, via the Internet. In one aspect, a warning is generated when, based on a vehicle's location and current rate of speed, it is predicted that the vehicle will enter an intersection when a traffic signal controlling the intersection would make it illegal to do so. In a further aspect, the warning is provided, via the Internet, to nearby vehicles and pedestrians through their own user devices. In still further aspects, automatic vehicle control countermeasures are taken when an impending violation of a traffic control is predicted. Other aspects are also disclosed herein.

One skilled in the art will readily recognize from the following discussion that alternative embodiments of the structures and methods illustrated herein may be employed without departing from the principles of the invention described herein.

DETAILED DESCRIPTION OF THE EMBODIMENTS

Embodiments of the present invention provide systems, methods, and computer-readable storage media that use location-based technologies such as GPS or cellular to provide improved traffic control and human safety. Embodiments include one-way or two-way communication via the Internet between traffic signals and users, and between users and a traffic database. Drivers are equipped with user devices that report their location to a controller for at least one traffic signal and optionally also report the driver's destination. The traffic signals are controlled by the controller to advantageously cycle through green and red lights according to a desired impact on traffic conditions for vehicles moving through the controlled intersection. In one implementation, the controller also sends information to the user devices to suggest the fastest route to the driver's destination, the time until a traffic signal turns green or red, a suggested speed to travel to arrive at a controlled intersection when the light is green, a warning that a vehicle appears likely to enter the intersection on a red light, and/or a variety of other directions to improve traffic handling and safety.

Figure 1:
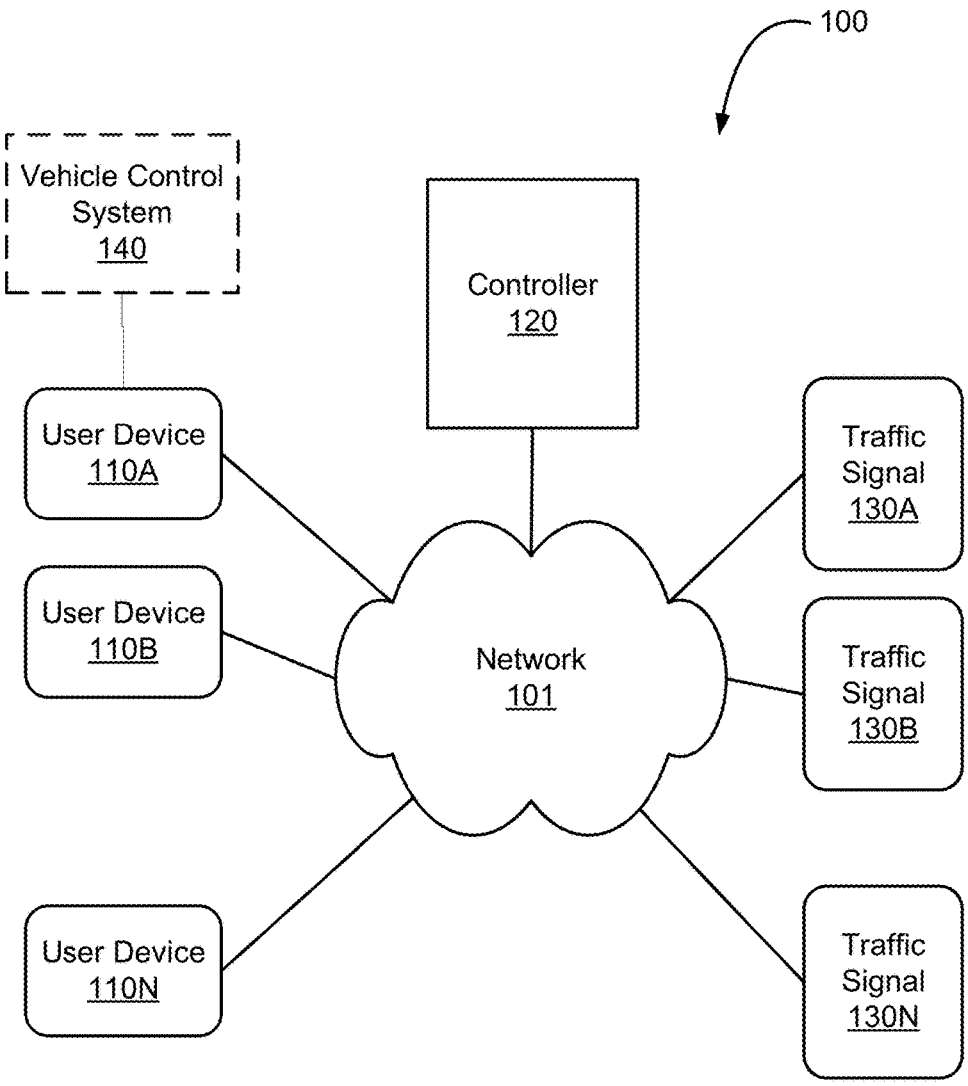
FIG. 1 is a high-level block diagram of the computing environment in accordance with an embodiment described herein.

FIG. 1 is an illustration of a system 100 in accordance with one embodiment of a routing system. The system 100 includes a plurality of user devices 110A-N, that are coupled to a network 101. In various embodiments, user devices 110 may include a computer terminal, a personal digital assistant (PDA), a wireless telephone, an on-vehicle computer, or various other user devices capable of connecting to the network 101. In various embodiments, the communications network 101 is a local area network (LAN), a wide area network (WAN), a wireless network, an intranet, or the Internet, for example. In one specific embodiment, user device 110 is an iPhone® device provided by Apple, Inc. and programmed with a user-downloadable application providing one or more of the functions described herein.

The system 100 also includes a plurality of traffic signals 130A-N that are connected to the network 101 and at least one controller 120. In one embodiment, the traffic signals 130A-N are all the traffic signals for all the controlled intersections in a local area. In one implementation, the controller 120 controls the operation of all the traffic signals 130A-N in the system. Alternatively, one controller 120 may control a subset of all the traffic signals 130A-N, and other controllers may control a portion or all of the remaining traffic signals. In still another embodiment, system 100 does not control any traffic lights. In some embodiments, a user device, e.g., 110A, further interfaces with a vehicle control system 140, such as via a Bluetooth or wired connection, to control aspects of vehicle operation as described herein.

Figure 2:
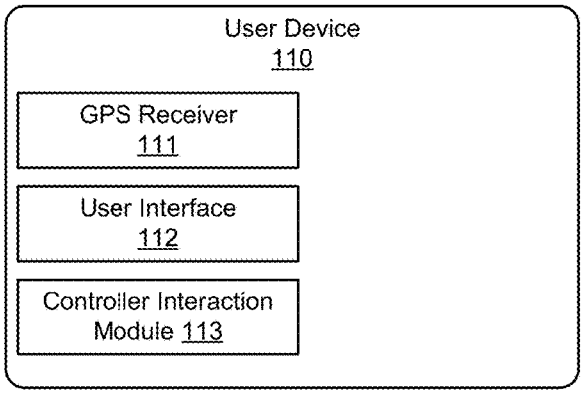
FIG. 2 is a block diagram of a user device, in accordance with an embodiment described herein.

FIG. 2 is a block diagram of a user device 110, in accordance with an embodiment of the invention. In one embodiment, one user device (e.g., 110A) is in the vehicle with the driver when in operation in the system 100, and another user device (e.g., 110B) is on the person of a pedestrian or in another vehicle. In one embodiment, each user device 110 includes a GPS receiver 111, a user interface 112, and a controller interaction module 113.

The GPS receiver 111 of the user device 110 functions to identify a precise location of the user device 110 from GPS satellite system signals received at the user device 110. Suitable GPS receivers are commonly found in handheld computing devices such as cell phones, on-board navigation systems, and other electronics. The GPS receiver 111 determines the location of the user device 110 for communication to the controller 120. Alternatively, cellular signals or other known location-determining technologies may be used to determine the position of the user device 110. For clarity, the location is discussed herein as having been determined from GPS signals although GPS signals, cellular signals or other technologies can be used in alternate embodiments.

The user interface 112 of the user device 110, discussed in greater detail below with respect to FIGS. 7-9, allows the user to input information into the user device 110 and displays information to the user. For example, the user may input a desired destination into the user interface 112 of the user device 110. The user interface 112 may display directions or a route to travel to arrive at the desired destination. The user interface 112 may also display other information relevant to the driver derived from the GPS signals received by the GPS receiver 111, received from the controller 120, or from other sources, such as current rate of speed, upcoming traffic signals, the light status of such traffic signals, and the like.

The controller interaction module 113 of the user device 110 manages the communication between the user device 110 and the controller 120. Specifically, the controller interaction module 113 sends the location information determined by the GPS receiver 111 to the controller 120 and receives the controller's messages to the user device 110 regarding traffic, navigation routes, traffic signals, and the like. As detailed below, the functions of controller 120 may in actuality be spread among multiple controller devices, for instance one under the authority of a municipality and another under the authority of a private company.

Figure 3:
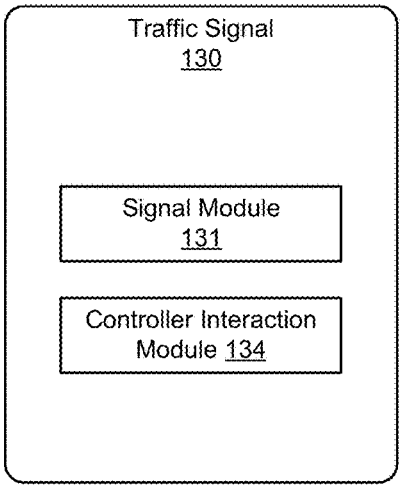
FIG. 3 is a block diagram of a traffic signal, in accordance with an embodiment described herein.

FIG. 3 is a block diagram of a traffic signal 130, in accordance with an embodiment of a routing system. The traffic signal 130 includes a signal module 131 and a controller interaction module 134.

The signal module 131 processes instructions to turn the traffic signal lights off and on and processes instructions regarding the timing of the light cycles (e.g., from green to red back to green, or in other cases from green to yellow to red and back to green). The signal module 131 may be programmed with a set of default rules for timing of the light cycles based on time of day, day of week, etc. In one embodiment, these default rules are subject to be changed based on instructions received from the controller 120. In other embodiments, the controller 120 instructs the signal module 131 of the traffic signal 130 with respect to every change in status of the light. In yet another embodiment, the controller 120 does not influence the operation of the traffic signal.

The controller interaction module 134 of the traffic signal 130 manages the communication between the controller 120 and the traffic signal 130. Specifically, in one embodiment, the controller interaction module 134 receives the instructions from the controller 120 and passes them to the signal module 131 for controlling the status of the light. (In another embodiment, the controller 120 does not send instructions for controlling the status of the light.) In some embodiments, the controller interaction module 134 sends a report to the controller 120 on the updated status of the lights of the traffic signal 130.

Figure 4:
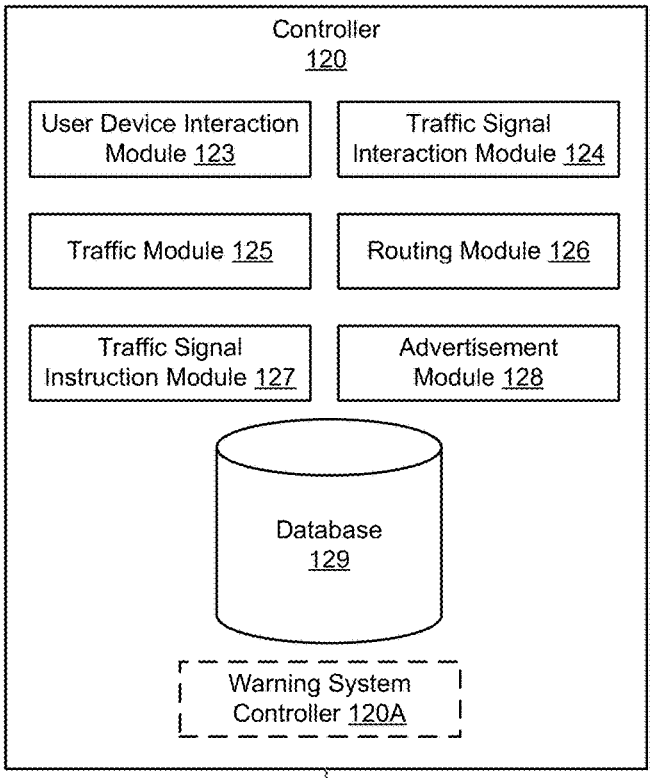
FIG. 4 is a block diagram of a controller, in accordance with an embodiment described herein.

FIG. 4 is a block diagram of a controller 120, in accordance with an embodiment of the routing system. The controller includes a user device interaction module 123, a traffic signal interaction module 124, a traffic module 125, a routing module 126, a traffic signal instruction module 127, an advertisement module 128 and a database 129.

The user device interaction module 123 of the controller 120 manages the communication with the user device 110 from the controller's side. The user device interaction module 123 receives location information and optionally destination information from the controller interaction modules 113 of the user devices 110 and sends traffic, routing, or traffic signal related information to the user devices 110 via the user device interaction module 123. Likewise, the traffic signal interaction module 124 of the controller manages the communication with the traffic signal 130 from the controller's side. The traffic signal interaction module 124 may send instructions to the traffic signals 130 and may receive status updates regarding the status of the lights of the traffic signals 130 in various embodiments.

The traffic module 125 receives the location information identifying the location and, in some embodiments speed, of the user devices 110 from the user device interaction modules 123 and stores the information in a database 129. The traffic module 125 may also store information regarding traffic conditions from other sources such as other users with user devices 110, traffic services, news reports, and the like. The traffic module 125 may also receive data regarding events likely to influence traffic such as construction projects, emergency vehicle activity, and the like. The traffic module analyzes the received traffic data to determine current and in some embodiments predicted future traffic conditions, and the traffic module 125 may report traffic conditions through the user device interaction module 123 to the user devices 110.

The routing module 126 combines the information communicated to the controller 120 about the locations of the user devices 110 and optionally their destinations with the traffic conditions assessed by the traffic module 125 to prepare routing instructions for the user devices 110. In some embodiments the assessment includes observed traffic conditions, predictive analysis, or both. The routing module 126 may also consider the status and timing of the traffic signals 130 to recommend routes and speeds that result in less time for drivers spent waiting at red lights or that are otherwise advantageous, as well as to provide predicted speeds for all or part of a recommended route.

In embodiments in which the controller 120 influences traffic signals, the traffic signal instruction module 127 combines information communicated to the controller 120 about the locations of the user devices 110 and optionally their destinations with the traffic conditions assessed by the traffic module 125 to prepare instructions regarding when to turn lights off and on and the appropriate timing for the cycle of lights. The traffic signal instruction module 127 may be programmed with a set of rules regarding constraints. For example, emergency responder vehicles may be given priority to reach their destinations without interruption by stoplights. Further constraints may include a maximum limit to the time length of a light, the maximum number of cars waiting for a light to change, the relative timing or synchronization between lights, and so forth. In one embodiment yet another constraint is presence of one or more other vehicles being routed and tracked by the system 100. For example, it may be known that a tracked vehicle will trigger a light's proximity sensor and cause it to cycle, because the system 100 is routing the vehicle on a known path and is aware of the vehicle's position.

The advertisement module 128 is included in certain embodiments to present the user with advertising related to a route request. For example, if routing module 126 has determined a route that passes nearby to an advertiser, advertisement module 128 is configured to present an advertisement, such as a coupon, to the user. In one embodiment, advertisement module 128 is configured to detect a destination request from the user that is related to an advertiser, because the advertiser has specifically requested activation upon that destination request (e.g., entry of a competitor's destination) or because the advertiser has requested activation upon any destination request of a particular type (e.g., electronics store). In still another embodiment, mere proximity of a route to a sponsored location triggers an advertisement. Once it is determined that a requested destination relates to an advertiser by one of these mechanisms, advertisement module 128 generates an appropriate coupon or other advertisement for display on user device 110.

Advertisement module 128 is configured in certain embodiments to provide information about an advertiser to a user even in circumstances where the advertiser's location and the requested destination are in dissimilar directions. In some instances, the advertiser's location may be in another direction but closer or quicker in driving time than the originally requested destination. In other instances, the information about an advertiser (such as a discount coupon) may provide an incentive for a user to go to that advertiser's location even if it is not closer or quicker.

If the user originally selected an advertiser's location as a destination, it may still be appropriate to provide the user with a coupon or other information about that advertiser, for instance to ensure that the user actually decides to go to that location or to encourage the user to make additional purchases from the advertiser.

In some embodiments, in addition to or instead of an advertisement, other relevant information is generated for display on user device 110. For example, should a user input a destination location corresponding to a retail store and that store will be closed at the estimated arrival time (as determined by review of the store's web site or as populated in a database of such information), a message warning the user that the store will be closed is displayed on user device 110 and the user is asked to verify whether that destination is still desired. In some embodiments, an alternate proposed destination (i.e., a store that will not be closed) is suggested to the user via display on user device 110 as well.

A single database 129 is shown in FIG. 4 as internal to the controller 120, however in other embodiments, the database 129 may comprise a plurality of data stores, some or all of which may reside remotely from the controller 120. For example, the data stores may be elsewhere on the network 101 as long as they are in communication with the controller 120. The database 129 is used to store user device locations, traffic conditions, alternative navigation routes and maps, traffic signal information including locations and traffic signal instructions, and any other data used by the controller for purposes such as analysis or communication with user devices 110 or the traffic signals 130.

In some embodiments, aspects of the operation of controller 120 that deal specifically with warning third parties (i.e., other vehicles and pedestrians) of an impending traffic control violation are handled by a separate warning system controller 120A. Warning system controller 120A is in such embodiments implemented separately to allow it to be administered by a different authority than the other operations of controller 120. For example, in some installations controller 120 (handling the functions of traffic signal interaction module 124 and 127) may be administered through a municipality having authority over the intersection, while warning system controller 120A (handling other functions described above) may be privately administered, e.g., by a company providing mapping, routing, or other information to users. More generally, the functions described above regarding controller 120 are, in various embodiments, administered by one or more controllers having access as required to database 129, not all of which are necessarily under a common authority. Those skilled in the art will recognize that slightly different implementations may be appropriate for various situations and environments, and will determine which of several possible controllers is responsible for such functions. As one example, portions of database 129 and related processing functions may take place in a user device 110A of a vehicle about to run a red light at an intersection, at a user device 110B of a pedestrian about to cross the intersection, and at one or more central facilities remote from the intersection. Those skilled in the art will recognize that quickest warning times will be achieved by taking issues such as processor speed and network delays into account when determining what portion of processing optimally occurs at each location.

It also should be noted that implementation of some features described herein requires less than all of the subsystems and modules described above. For example, those drivers or pedestrians wishing only to receive warnings of possible red light runners need not have, for example, the modules relating to display and routing that a driver using the system 100 for navigation will have.

Figure 5:
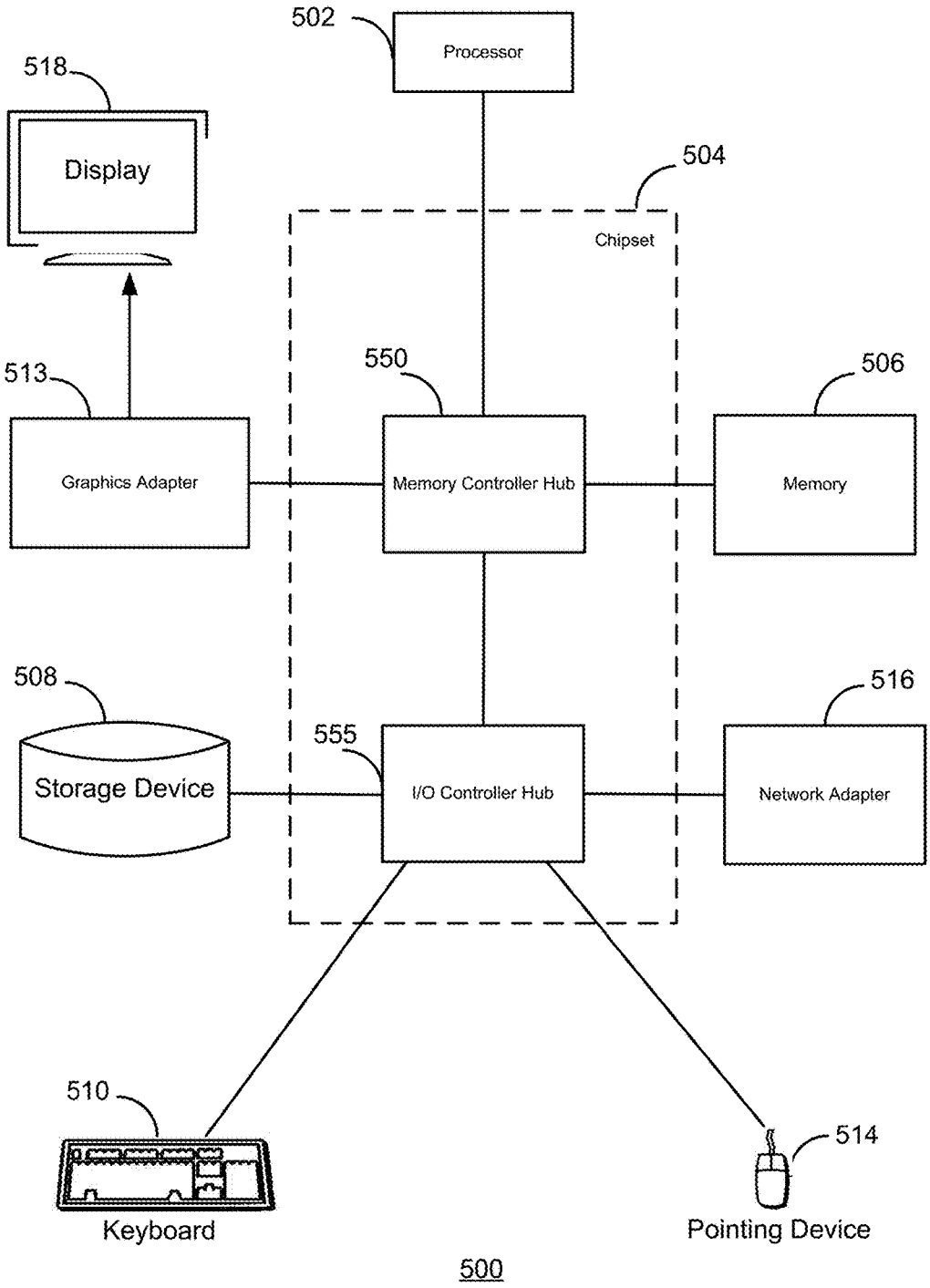
FIG. 5 is a block diagram illustrating an example of a computer for use as a user device, a traffic signal, or a controller, in accordance with an embodiment described herein.

FIG. 5 is high-level block diagram illustrating an example of a computer 500 for use as a user device 110, a controller 120 or a traffic signal 130, in accordance with an embodiment of the routing system. Illustrated are at least one processor 502 coupled to a chipset 504. The chipset 504 includes a memory controller hub 550 and an input/output (I/O) controller hub 555. A memory 506 and a graphics adapter 513 are coupled to the memory controller hub 550, and a display device 518 is coupled to the graphics adapter 513. A storage device 508, keyboard 510, pointing device 514, and network adapter 516 are coupled to the I/O controller hub 555. Other embodiments of the computer 500 have different architectures. For example, the memory 506 is directly coupled to the processor 502 in some embodiments.

The storage device 508 is a computer-readable storage medium such as a hard drive, compact disk read-only memory (CD-ROM), DVD, or a solid-state memory device. The memory 506 holds instructions and data used by the processor 502. The pointing device 514 is a mouse, track ball, or other type of pointing device, and in some embodiments is used in combination with the keyboard 510 to input data into the computer system 500. The graphics adapter 513 displays images and other information on the display device 518. In some embodiments, the display device 518 includes a touch screen capability for receiving user input and selections. The network adapter 516 couples the computer system 500 to the network 101. Some embodiments of the computer 500 have different and/or other components than those shown in FIG. 5.

The computer 500 is adapted to execute computer program modules for providing functionality described herein. As used herein, the term "module" refers to computer program instructions and other logic used to provide the specified functionality. Thus, a module can be implemented in hardware, firmware, and/or software. In one embodiment, program modules formed of executable computer program instructions are stored on the storage device 508, loaded into the memory 506, and executed by the processor 502.

The types of computers 500 used by the entities of FIG. 1 can vary depending upon the embodiment and the processing power used by the entity. For example, a user device 110 that is a PDA typically has limited processing power, a small display 518, and might lack a pointing device 514. The controller 120, in contrast, may comprise multiple blade servers working together to provide the functionality described herein. As noted above, the portion of data storage and processing performed by each device is preferably based in part on the processing power and available communication bandwidth for each such device.

Figure 6:
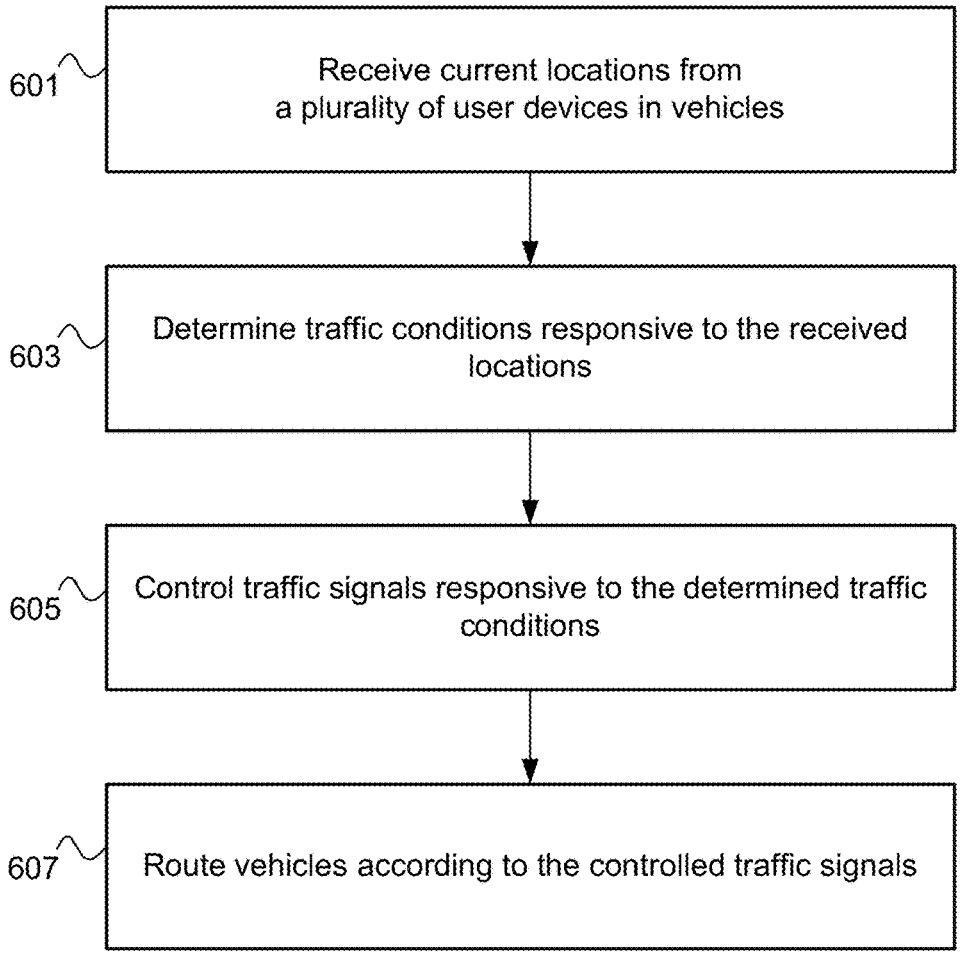
FIG. 6 is a flow chart illustrating a method of providing improved traffic routing, in accordance with an embodiment described herein.

FIG. 6 is a flow chart illustrating a method of providing improved traffic routing. In step 601, the current locations (and in some embodiments, speeds) are received from a plurality of user devices 110 in vehicles. The current locations may be ascertained using GPS or other signals by the user devices 110 and communicated to the controller 120 via the network 101, for example. In some embodiments, the destinations of the users are also communicated from the user devices 110 to the controller 120.

In step 603, the traffic conditions are determined responsive to the received locations of the user devices 110. In some cases, the traffic conditions are also determined responsive to other sources of traffic information such as traffic websites, traffic services, etc. In one embodiment, roadwork and emergency vehicle activity are also considered in determining the traffic conditions. In one embodiment, system 100 provides predictive modeling of anticipated traffic speeds based on the various sources of information provided to system 100.

In step 605, optionally, traffic signals are controlled responsive to the determined traffic conditions. For example, instructions are sent from controller 120 to individual traffic signals 130 to turn them on or off or adjust the timing of the light cycles to ease congestion identified in the traffic conditions.

In step 607, vehicles are routed according to the controlled traffic signals and other traffic information. For example, the controller 120 may send route information or speed information to the user devices 110 to enable the drivers of the vehicles in which the user devices 110 reside to avoid red lights and/or avoid congested areas if the instructions from the controller 120 with respect to the route information or speed information are obeyed.

Embodiments that provide systems, methods, and computer-readable storage media that use location-based technologies such as GPS to provide improved traffic routing have been described above. Benefits of these embodiments include:

1. Better synchronization of drivers and traffic lights. As a result, people can spend less time waiting at traffic lights. Additionally, better synchronization results in drivers being able to maintain a more constant speed and avoid abrupt accelerations and decelerations caused by stopping at traffic lights. Reduced acceleration/deceleration while driving results in increased miles per gallon of gas for cars and reduced carbon emissions. The better synchronization of drivers and traffic lights results in tangible benefits to everyone, including drivers who do not use the user devices 110, because embodiments of the invention avoid gridlock and generally improve the flow of traffic. Thus, helping a relative handful of drivers who use the user devices 110 to proceed smoothly will also help alleviate the burdens of traffic to the rest of the drivers.
2. Improved ability to clear roads for emergency responders. Not only can traffic lights be informed of an emergency response vehicle approaching in order to block cross traffic to avoid an accident, but also can turn appropriate lights green to relieve congestion in the path of an emergency response vehicle. Non-emergency traffic, meanwhile, is routed elsewhere so that by the time an emergency vehicle arrives at an intersection, there are fewer other vehicles in contention with it.
3. Improved ability to support mass transit. The traffic lights can be preferentially managed to support buses, trolleys, and trains to avoid having these mass transit vehicles wait for traffic lights. In addition, cars can be managed to avoid having to wait for trains or other mass transit vehicles.
4. Load balancing during busy periods. The traffic lights and signals to drivers can be managed so as to balance the traffic between a number of known traffic bottlenecks or popular routes (such as multiple bridges across a single river, and main thoroughfares into or out of an urban area).
5. Synchronization of drivers with each other. In one particular embodiment, drivers are directed among a plurality of routes according to characteristics of the vehicle, the driver, or the desired destination. For example, all trucks are directed to one thoroughfare and all cars are directed to another. This helps avoid the inconveniences to car and truck drivers of travelling on the same route. Namely, trucks reduce the visibility that smaller cars have of the road and trucks' longer acceleration times can frustrate car drivers. The shorter braking distance of cars compared to trucks increases the risk of collisions when both are travelling the same route. Also, truck drivers prefer to travel near other trucks to save on fuel by drafting off of each other. As another example, everyone on route A plans to exit in no less than 5 miles, whereas everyone on route B plans to exit in less than 5 miles. This may improve traffic flow through congested areas.
6. Prediction and avoidance of congestion. Drivers can be routed around congested areas, thus easing congestion. This results in less driving time and lower carbon emissions.
7. Improved traffic monitoring. The results of accurate traffic monitoring can be used in many applications, such as to plan new roads and improvements to infrastructure, or to coordinate the timing of construction projects on infrastructure to lessen the impact on drivers.
8. Accurate real-time traffic information, including on city streets. Accurate traffic information is useful for trip planning and commuting. The real-time traffic conditions could be used as inputs into various other scheduling systems to ensure timely arrivals for meetings, events, etc. For example, based on the traffic conditions for any given day, an alarm clock may be programmed to wake a person up 30 minutes before he needs to leave for work in order to arrive on time.

The discussion above addresses a system in which there is two-way communication among vehicles and traffic systems. In other embodiments, even simpler one-way communications are used. Specifically, a location-aware user device 130 such as a smart phone in a vehicle sends a message via the Internet to traffic signal 130 indicating that the vehicle is approaching the traffic signal 130 from a particular direction and may also transmit the vehicle's destination. If appropriate, traffic system 130 changes its operation so as to allow the vehicle to pass with minimal slowdown. As a specific example, consider a smart phone such as the iPhone® device provided by Apple, Inc. and mentioned above. Such device is location-aware and is readily programmed by software applications to perform a variety of functions. In one specific embodiment, a software application directs the device to periodically send its location and optionally the vehicle's destination to a specified site via the Internet, for example controller 120. Depending on the vehicle's location and heading, controller 120 then sends traffic signal 130 a signal indicating that traffic is approaching from a particular direction. If appropriate (for instance during late-night hours with little expected traffic), traffic signal 130 then changes the state of its lights so as to allow the vehicle to pass without having to stop.

Such one-way communications via the Internet can also be used effectively in environments having multiple vehicles with user devices 110. For example, controller 120 can compare the number of eastbound/westbound vehicles at a particular intersection with the number of northbound/southbound vehicles and cause traffic signal 130 to adjust its light cycles accordingly.

One-way communications in the other direction (i.e., from the traffic signal to vehicles via the Internet) may also be effective. For instance, a software application on user device 110 may obtain from the traffic signal 130, via controller 120, an indication that a light has just turned red and will not turn green again for one minute. If the intersection is not visible to the driver, for instance because the approach is hilly or on a curve, this information can be used to tell the driver that there is no point in approaching the intersection quickly, since the vehicle will only need to wait for the green light anyway. Thus, safety can be enhanced near "blind" or otherwise dangerous intersections. In addition, knowledge of the cycle of a traffic signal from a distance can help drivers time their approaches to controlled intersections to coincide with a green light. Thus, drivers can reduce the time they spend waiting at red lights.

In one specific embodiment, users are provided incentives to keep their devices in active operation while enroute, rather than just at the outset of a journey. This is advantageous to all users of the system because the more users who are "live" on the system (e.g., have the appropriate application operating on their user devices 110), the more information can be collected from such users regarding traffic information at various locations. Using the example of an iPhone, for instance, if an "app" implementing the system is kept on during transit, not only will the user obtain updated information, but the system will obtain ongoing information from that user, such as traffic speed at the user's location.

In order to provide such incentive, a user interface of the application running on user devices 110 provides updated information during travel. In one particular embodiment discussed in greater detail in connection with FIGS. 7-9, the predicted state of a light that the user is approaching is presented to the user differently depending on the certainty of the prediction. For example, a visual display of the light's predicted state can start out, when the prediction is relatively uncertain, as a rather faded color, and increase in intensity as the certainty grows. As another example, a change in a light's predicted state can be announced to the user by audio as well as visual messaging, and the proposed route can likewise be altered on the fly if an originally preferred route now appears suboptimal due to changes in the predicted state of one or more lights.

In some embodiments, multiple types of displays are presented to users indicating information regarding a light's predicted state, such as minimum speed to reach the intersection while the light is still green, maximum speed to reach the intersection above which increased speed would only result in waiting for the light to turn green, colored indicators showing predicted state of the light that do not suggest a speed but are based on not exceeding the speed limit, and simple "SPEED UP" or "SLOW DOWN" messages for a current route. In these embodiments, data regarding a user's actual speed is collected from user devices 110 over time and used to determine which information display leads to the safest behavior (greatest conformance to speed limit least running of red lights, etc.). In one embodiment, this is done by a machine learning module (not shown) implemented, for example, by controller 120 If it is found that one type of indicator results in safer driving then that display is used. Over time, it may be that for one driver a first type of display results in safer driving while for another driver a second type of display results in safer driving. In such case, the display is individualized for each driver accordingly.

Various alternate embodiments permit a range of such processing to be employed. In one alternate embodiment, machine learning for system 100 is implemented by providing different drivers with different types of displays, and then determining after a period of time which of the displays results in the safest driving averaged over all users. In another embodiment, different displays are presented to a driver at different times, and the safest design for each driver eventually becomes the one that is presented most often or, in some embodiments, the only one that is displayed. To accomplish the machine learning, system 100 is configured in one environment to sometimes provide only a first display to a user device 110 and other times only provide a second display to the user device 110. In another possible embodiment using a more subtle approach, user device 110 is instructed to provide a first display initially followed by a second display, such as a green dot followed by a proposed speed. Using data uploaded from user device 110, inferences are made as to whether a driver began to exceed the speed limit only after the second display appeared. The order in which the displays are updated is in some embodiments switched while in a learning phase to allow for more complete testing of which displays lead to safer driving.

In some embodiments, traffic data collected from user devices 110 over a period of time is stored in database 129 and processed further by controller 120 to determine or refine routes proposed by routing module 126. In one specific embodiment, vehicle speed information collected over a period of time is used to determine the presence of stop signs that were not previously known by the system. Knowledge of where such stop signs are located allows the system to build in appropriate delays when considering routes that include intersections with those stop signs. Similarly, over a long period of time it may be evident that no user devices 110 have traversed a given portion of a mapped road. Such data may indicate that the road was planned but never built, that the road has been closed, or that the road is unavailable for use for some other reason. Based on such collected data, in some routing module 126 ignores such road segments as being available for a proposed route. Conversely, location and speed data from user devices 110 may indicate that a new road has been built that is not on the base map loaded into database 129, and if there is enough vehicular use of such a route, then routing module 126 assumes such a path, even though not mapped, is available for a proposed route.

Still more detailed collected and real-time information from user devices 110 is used by system 120 in certain embodiments. Real-time average vehicle speed from other vehicles, historical average vehicle speed, vehicle speed variance over time, deviation of a given user's vehicle speed compared to other vehicles' speeds over the same route (indicating an aggressive or conservative driving manner) and best/worst case speed data are all used as inputs by system 120 to predict the time it will take a vehicle corresponding to a particular user device 110 to traverse a specific segment of a possible path.

As one example, by collecting data system 100 may determine that a particular segment of road is subject to 25 mph speed limits during certain times and 40 mph speed limits during other times, for instance indicating a school zone with a reduced speed limit sign that flashes to invoke the lower limit during times when children are present. Further, system 100 determines that some users tend to be conservative and drive according to the 25 mph sign regardless of whether the lights are flashing, while others reduce speed only when the lights are flashing. For users who reduce speed all of the time, system 100 routes them based on a lower expected speed regardless of the actual speed limit; other users get routed based on an expectation that they will match the actual speed limit in effect at the time. Changes in speed limit also occur on some roadways based on time of day, vehicle type (truck or automobile), construction activity and the like. In some embodiments system 100 detects patterns in collected data indicating such changes and accounts for them in determining routes and estimating transit times.

In certain embodiments, system 100 adaptively segments routes into smaller pieces over time when collected data suggest such smaller segmentation will yield more accurate estimates of travel time. For example, system 100 may start out by considering the entirety of a street as one segment, but data collected over time may indicate that there is a school zone impacting a certain portion of the road. In response, system 100 divides the road into three segments, so that those who exit the road well before the school zone are not considered subject to the reduced speed limit that would affect a driver going past the school.

Further extending this example, school bus routes often slow traffic considerably, but only for a small portion of each day. By collecting information from user devices 110 over a period of time, system 100 may infer that during school days, certain routes that otherwise have a much higher average speed will be congested at specific known times. During those times, preference is given to routes that avoid approaching or following a school bus. Not only does such routing improve transit times, but it also increases safety by reducing the number of conflict points between vehicles and children getting on or off a bus.

Other factors that can be considered for such correlations include rush hour, weekday/weekend differences in travel, large sporting events or conventions, holiday shopping times, freight or commuter train crossings, ferries, radar speed enforcement and the like. A particular advantage of using data collected from user devices 110 for this purpose is that temporal changes in estimated segment transit times and correlations do not need to be calculated for all road segments, but only those showing significant time-dependent variations. Processing requirements for system 100 are thus dramatically reduced compared with a system configured to make temporal predictions for all road segments.

In some instances, external data sources are used instead of, or in addition to, the collected data referenced above. For example, in one embodiment significant periodic changes in observed traffic at a particular location trigger system 100 to search external data sources (such as through a location-based internet search) to determine a cause of such changes, such as presence of a school, church, railroad crossing or sports venue; notice of a period of road construction; or public warning that a road is only seasonal and is not maintained in winter. In such embodiments, system 100 is programmed to then search for information that correlates with the observed data and can be used to make predictions for transit time in the future. In an exemplary embodiment, should system 100 determine, by a location-based search, that a school is located where there are large variations in transit time, system 100 then searches the Internet for a school calendar and extracts information as to what days the school is open so that the system can predict when traffic is likely to be slowed down in the vicinity of the school.

Determination of such roadside features can be used to augment previously known features for various purposes. For example, a map database may not include an indication that the school referenced above is at a certain location, but after presence of the school is inferred based on observed data, that information is usable for purposes such as vehicle routing. As one specific example, an application providing driving directions makes use of the data to augment the manner in which information is presented to a driver, so that instead of stating "make a right on Oak Street" more helpful directions can be given, such as "make a right after passing the school, onto Oak Street". As detailed in the previously referenced co-pending U.S. patent application Ser. No. 13/425,707, features such as traffic lights and stop signs can be detected by such observations, so augmented GPS directions such as "turn right at the light onto Main Street" are provided in one embodiment, even when a primary map database does not indicate that there is a traffic light at that intersection. Further such augmentation is available in some embodiments using location-based advertisements, as an additional benefit to advertisers. A location-based advertiser will typically provide a location for its business, which can then be used as described above to augment GPS directions (e.g., "Turn right just after the Starbucks onto Elm Street").

Figure 7:
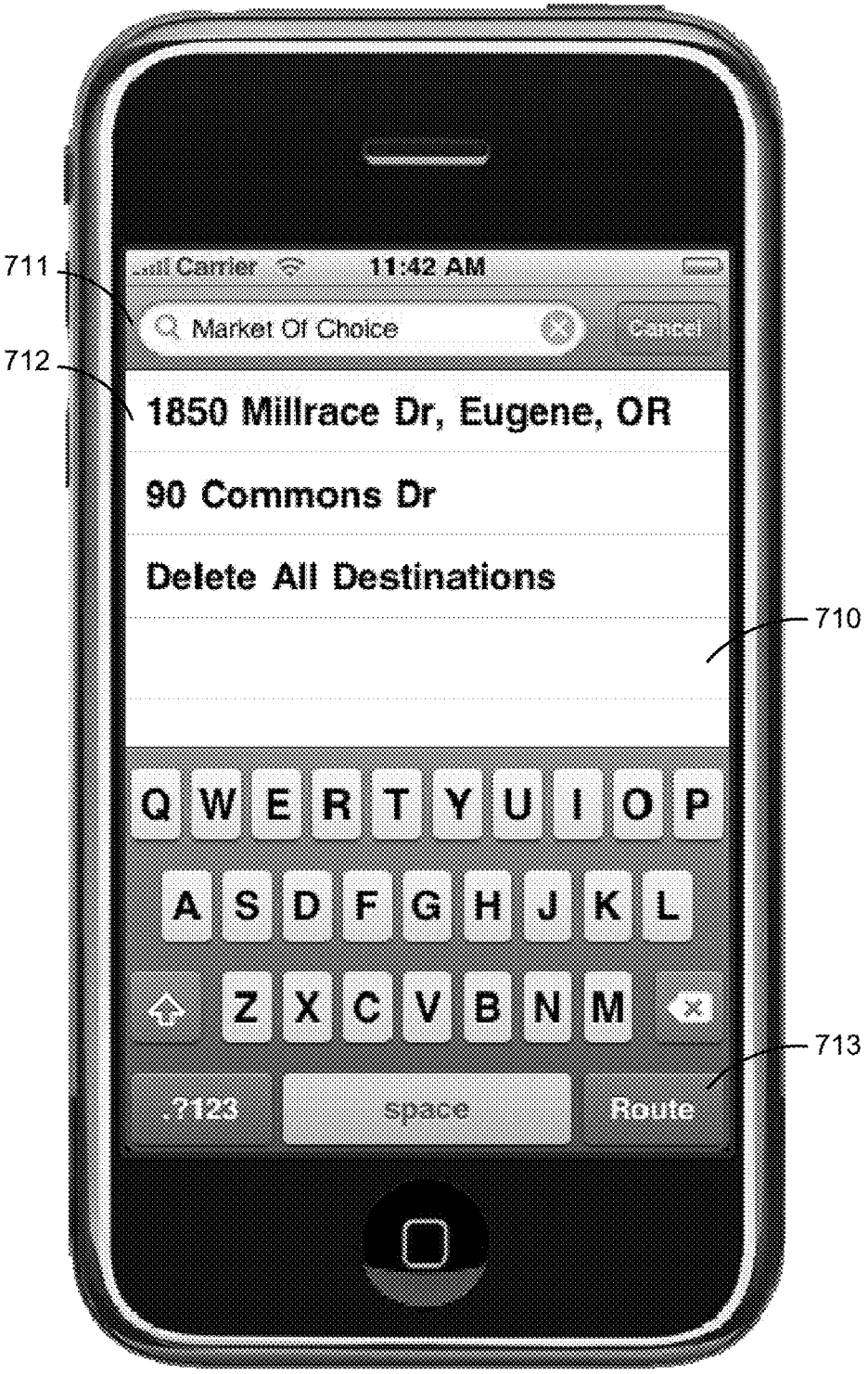
FIG. 7 is a destination display in accordance with an embodiment described herein.
Figure 8:
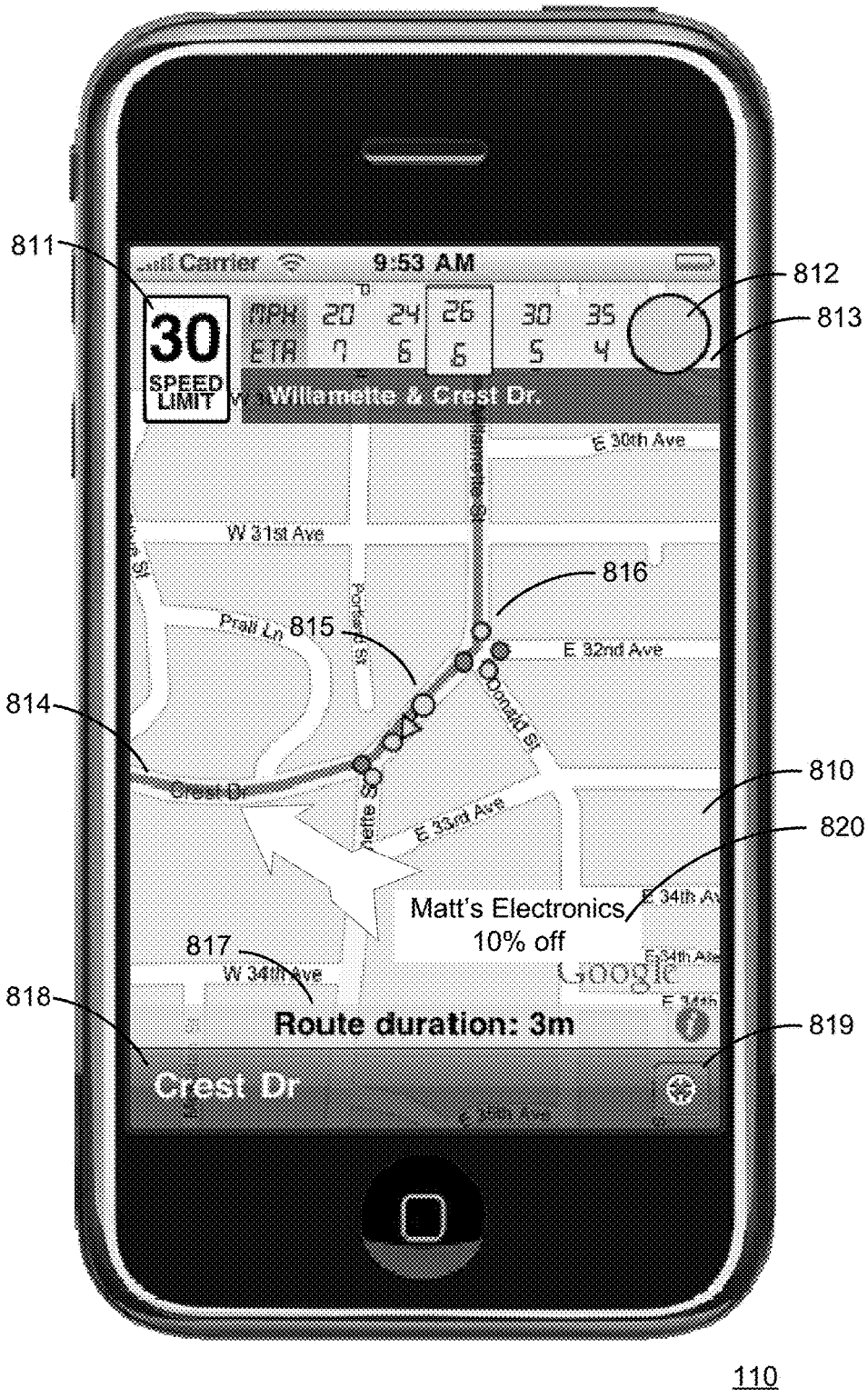
FIG. 8 is a routing display in accordance with an embodiment described herein.
Figure 9:
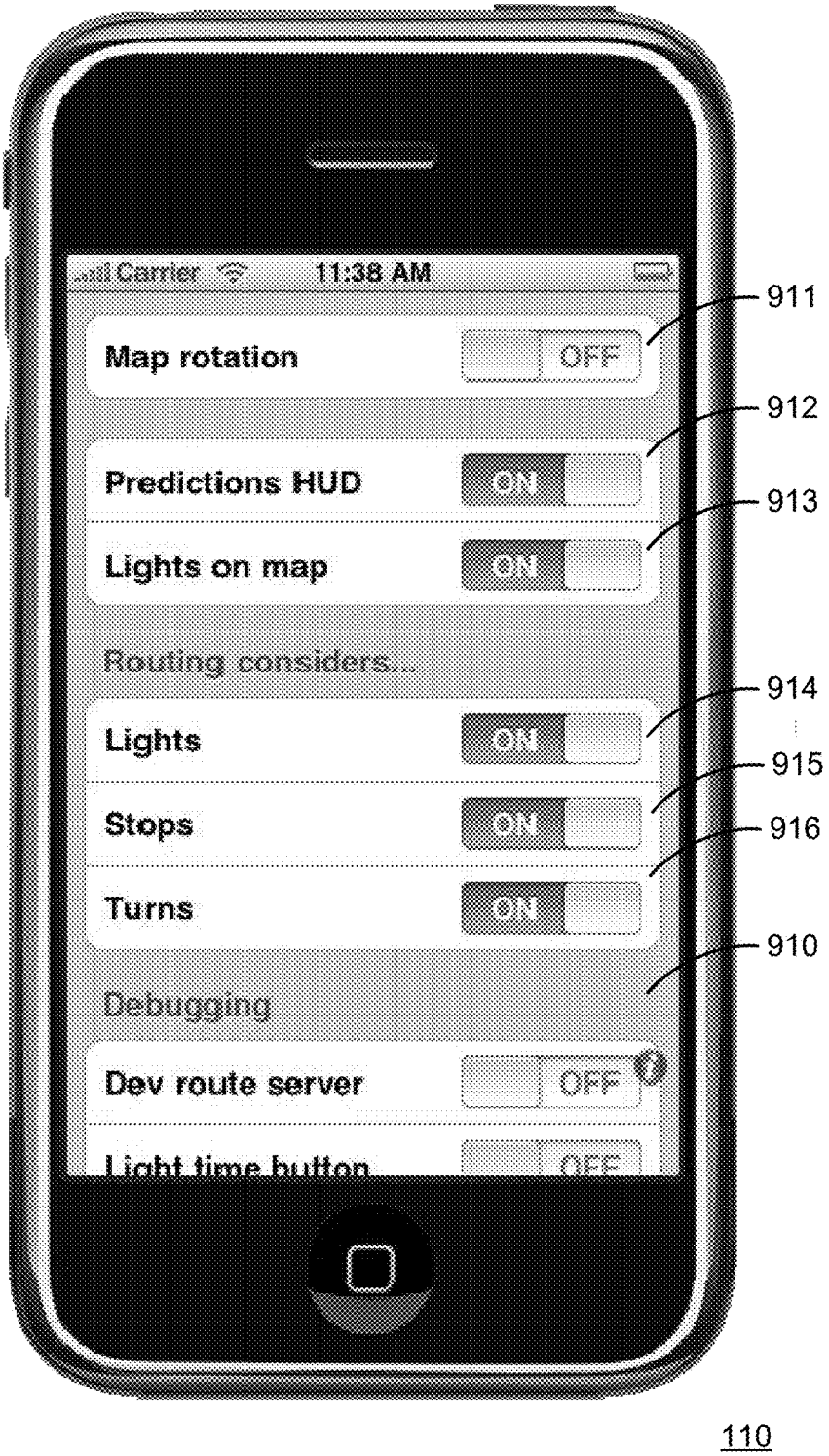
FIG. 9 is a settings display in accordance with an embodiment described herein.

Referring now to FIGS. 7-9, the user interface 112 of user device 112 from FIG. 2 is implemented via a display system that includes a destination display 710 shown in FIG. 7, a routing display 810 shown in FIG. 8, and a settings display 910 shown in FIG. 9.

Specifically, destination display 710 is configured to be a starting place for a driver's use of the system. A search bar 711 allows a user to enter a new destination by entering text to represent a street address, intersection, or business name; alternatively the system allows a user to select a destination from a list of previous destinations 712. In one embodiment, if no destination is selected, the system will be in a "cruising" mode in which it is assumed that the driver will remain traveling as straight as possible; once the driver turns, the system again assumes that the driver will travel as straight as possible.

Upon user selection of route button 713, user device 110 switches to routing display 810 shown in FIG. 8. Routing display 810 is configurable to show a user's current position, starting location and ending location, as well as speed, traffic light and route information. A speed limit indicator 811 shows the speed limit at the driver's current location, based on known data as discussed above. This indicator normally has a white background, but in one embodiment gradually turns to red as the driver's speed exceeds the legal limit. Also provided are a traffic light indicator icon 812 and an information bar 813. Indicator icon 812 is intended to be large enough for a driver to easily see at a quick glance, and is color-coded to show the state of an upcoming traffic light. In one embodiment, the color coding relates to the current state of the light; in another embodiment the color coding relates to the system's prediction as to whether an upcoming traffic light will be red or green upon the user's arrival. In one embodiment, predictions of the state of an upcoming light may be more or less certain, as discussed above, and the icon will be colored more intensely to show a strong prediction and in a more faded manner to show a weak prediction. Information bar 813 is also color coded, with a background color indicating both a predicted state of the light and confidence in that prediction at the time the user is expected to arrive. The user's actual speed is shown by a surrounding box and a range of speeds surrounding the current speed limit is also displayed. The ETA in this instance indicates that the user would arrive at the light in seven seconds if traveling at 20 mph, as opposed to six seconds at the driver's current rate of 26 mph. The name of the upcoming intersection is also provided at the bottom of bar 813. Drivers can use bar 813 to determine, for example, whether to slow down because the light will be red at the time of arrival regardless of the current speed. Display 810 also shows the states of other nearby traffic lights (e.g., 816), the driver's current location 815, and the selected route 814. The duration of the route is also shown 817, as well as the destination 818. In some circumstances in which a user has moved the map display so that the current location 815 is off the screen or perhaps disabled indication of the current location, user tracking button 819 allows the user to once again display current location 815.

In another embodiment, routing display 810 includes an indicator that displays the time remaining before an upcoming light changes state. If the upcoming light is changing to red and there is time to spare, the driver would, among other things, be able to save fuel by driving only as fast as necessary to pass the light in time. If the timer indicates that the driver will not reach the green light, the driver may slow down to save fuel since he will be stopping at the red light regardless of the speed he travels. A timer that shows how long until a light turns green can also provide impetus for a driver to slow down. A driver may be inclined to slow down and save fuel if he knows that he will still arrive at the next light by the time it turns green.

As noted above, system 100 is also capable of determining and storing how certain indicators affect the behavior of drivers. In one embodiment this data is used to determine whether the indicator should be displayed to the driver in the future. If an indicator promotes unsafe behavior, it may no longer be shown to the driver. On the other hand, if an indicator causes a driver to adhere to the speed limit, it will continue to be shown. For example, if displaying the time remaining before a light turns red causes the driver to go as fast as is necessary to reach the light in time, the indicator may no longer be shown. Similarly, if the information bar 813 indicates that the traffic light will be green when the driver reaches it if the driver exceeds the speed limit, the driver may choose to travel faster than the speed limit. Given a driver's history, the system can choose to not display certain indicators that are found to promote unsafe driving. Rules determining which indicators should be displayed can be applied to multiple drivers or to specific drivers based on their actions. In some embodiments, the user may be given a choice of whether indicators promoting unsafe behavior such as speeding should be displayed or suppressed.

In one embodiment, routing display 810 also includes location-based advertisements 820, such as a coupon and prominent arrow showing the location of an advertiser. Selection of an advertisement 820 is, in various embodiments, dependent upon context. In one embodiment, an advertisement is selected for display based on the destination that the user has selected. In the example shown in FIG. 8, a coupon for an electronics store is displayed. This may be in response to the user entering a destination location that is a competing electronics store, for instance. In another embodiment, location-based advertisements are selected based on the projected path of the user. In other embodiments, location-based advertisements are selected based on keywords used while in the destination display 710, recent web searches, user profile information and other characteristics that can be gleaned from historical use of user device 110.

In one embodiment, advertisements based only on proximity of the user's location, or a proposed route, to a sponsored business are displayed on user device 110. Thus, a user seeking an electronics store may be provided with an advertisement for a coffee shop not far from the proposed route to the electronics store. In some embodiments, other information relating to destinations is provided as well. As one example, if a destination is an electronics store and that store will be closed at the expected arrival time of the user, a warning message to that effect is displayed on the user device 110. Likewise, if the user has input a parking facility as a destination and that facility is full, such information is provided on the user device 110. In these instances, in certain embodiments alternate destinations are suggested via display on user device 110 (e.g., a store that will still be open or a parking facility that is not full). Display of such suggested destinations is in some embodiments influenced by sponsorship such that certain alternate destinations are favored over others based on such destinations paying for that benefit.

Referring now to FIG. 9, a settings display 910 provides user selection of various display-related features. A map rotation control 911 determines whether the displayed map is oriented to the direction of travel or in a conventional "North-up" mode. A "Predictions HUD" control 912 determines whether the traffic light indicator 812 and color bar 813 are displayed to the user. "Lights on map" control 913 is used to enable or disable display of traffic lights, e.g., 816. In addition to display-oriented controls such as these, settings display 819 provides controls that determine the behavior of routing system 100. "Lights" control 914 is used to determine whether delays due to traffic lights will be considered in estimating transit times. "Stops" control 915 likewise relates to whether delays for stop signs will be considered. "Turns" control 916 similarly enables or disables delay calculations for time spent making right or left turns.

Figure 10:
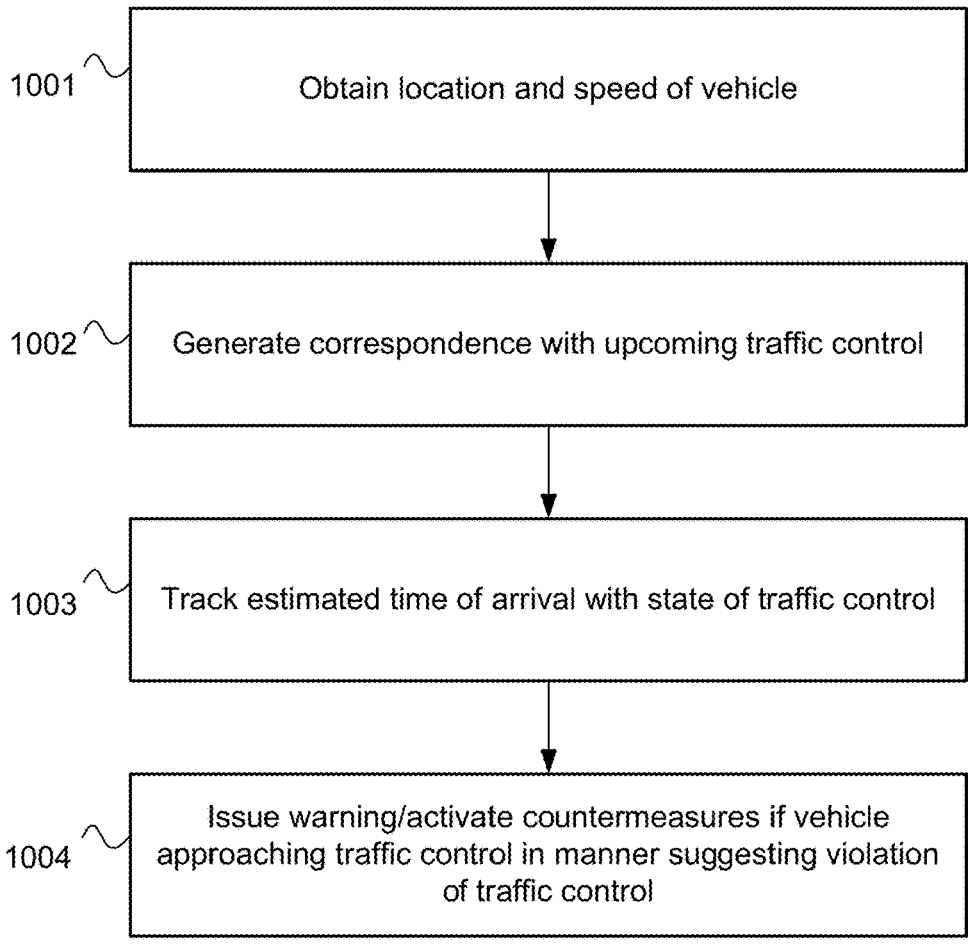
FIG. 10 is a flow chart illustrating a method of providing a warning that a vehicle is predicted to enter an intersection illegally, in accordance with an embodiment described herein.

In addition to providing helpful routing and speed control information, user devices 110 are in one embodiment also configured to provide a warning when a vehicle is about to pass a traffic control illegally, for instance by going through an intersection when a traffic light is red. FIG. 10 is a flow chart illustrating a method of providing such a warning. In step 1001, the current location and speed of a vehicle is determined and communicated to controller 120 as described above.

In step 1002, a correspondence is generated (i.e., determined) with an upcoming traffic control, e.g., traffic signal 130A. In one embodiment, routing information already provided by the driver is used to predict the next traffic control that the vehicle is expected to encounter; in another embodiment a simple geographical search is made for the next traffic control likely to be encountered based on the vehicle's current location and direction of travel. In one embodiment, a subsystem of controller 120, e.g., routing module 126, is programmed to generate the correspondence.

Once this correspondence is developed, information regarding the location and speed of the vehicle is used to estimate its time of arrival at the traffic control, and information regarding the current and historical states of the traffic control (for example, how long a traffic signal's light stays yellow before turning red) is used to predict the likely state of the traffic control at the time of arrival. In one embodiment, this information is updated from time to time. In one specific embodiment, the update is accomplished at regular intervals (e.g., every three seconds). In another embodiment, the update is accomplished based on changes in state (e.g., change of the state of the traffic signal, change in the speed of the vehicle). In yet another embodiment, the update is accomplished based on a factors, such as distance from the vehicle to an intersection (more updates as the vehicle gets closer). In various embodiments, combinations of such updating factors are used to balance processor and communications bandwidth loading against accuracy of prediction. In one embodiment, the estimated time of arrival is generated by routing module 126, and the likely state of the traffic signal at that time is generated by traffic signal interaction module 124.

In step 1004, controller 120 (or warning system controller 120A in embodiments using such a separate controller) sends a warning signal or activates countermeasures as detailed below 110 if the vehicle is getting sufficiently close to a traffic control (e.g., traffic signal 130) without slowing down (i.e., without indicating that the driver is preparing to stop) such that it seems likely that the vehicle will enter the intersection at a time when the traffic signal 130 will already have turned red. Not only absolute speed, but related dynamic factors such as trend of speed over time (i.e., acceleration/deceleration) and activation of the vehicle's braking system are used in certain embodiments to predict whether the driver of the vehicle is planning to stop at the intersection or proceed through it. In one embodiment, the warning is progressive, such as with short, low volume beeps at first transitioning to a loud continuous alarm tone as the vehicle approaches the intersection and the prediction of running a red light becomes more certain. In various embodiments, audible warnings (e.g., tones, voice), visual warnings (e.g., on a display 112 of user device 110, on a dashboard indicator light, on a heads up windshield display) or both are provided. In one specific embodiment, warnings begin at approximately 500 meters from an intersection when the vehicle is traveling at high speed or on a divided highway but at only 100 meters from an intersection when the vehicle is traveling at lower speed or on a small two-lane road. Other adjustments in the distance at which a warning is triggered include, in various embodiments, factors such as applicable speed limits, presence of blind curves in front of a traffic control, whether it is day or night, whether it is rush hour, and weather conditions. In some embodiments, operational parameters such as type of notification and operational distance are user-selectable based on personal preference. In one embodiment, the warnings are generated by user device interaction module 123. In embodiments in which network communications latencies may be significant (e.g., 3 G communications from a vehicle to the controller over the Internet and 3 G communications from the controller to another user device over the Internet), such operational parameters include consideration of communications delay time.

In another embodiment, the warnings are generated not only to a driver's own user device 110A, but additionally or alternatively to user devices 110 other than in the vehicle about to enter the intersection in violation of the traffic control. In one such embodiment, a warning that a vehicle with user device 110A is about to illegally enter an intersection is generated and issued via the Internet to other user devices within a certain geographical range of user device 110A (e.g., 500 meters). Thus, a second vehicle with user device 110B receives a warning putting its driver on alert for a potential red light runner. In another example, it is a pedestrian, rather than a driver, who is equipped with the second user device 110B, and is alerted to the potential impending danger. For example, a pedestrian's user device 110B is configured in one such embodiment to make a loud "honk" sound as the warning. In a third example, the warning is issued via the Internet directly to traffic signal 130N, which is configured in various embodiments to react to the warning in multiple manners. In one example, the traffic signal 130N sounds a loud alarm at the intersection; in another it turns all signals to red until the violating vehicle has either stopped or passed; in still another it activates all strobe lights at the intersection (e.g., those used for emergency vehicle passage and those used for illumination of traffic enforcement cameras).

To address possible latency issues of network 101, e.g., the Internet, in some embodiments data are provided to local processors, e.g., user devices 110A, 110B and processing is accomplished locally on those machines to determine whether a warning should be issued. In such embodiments, the general allocation of processing and communications is, for example, as follows. First, user device 110A inside a vehicle sends a message to controller 120 with its location, with new location messages being sent from time to time. Controller 120 processes this information and determines that the vehicle may be approaching a traffic light, and thus sends to the vehicle (via the Internet to user device 110A) the location of the traffic light and its status (e.g., light is now green but is expected to turn red in 5.2 seconds). The light status information is also refreshed periodically, for instance when the light turns to amber and then again when it turns to red. Should controller 120 be aware of another user device 110B, in this example carried by a pedestrian, in the vicinity of the intersection, it also sends to that device the information about user device 110A and the traffic light. User devices 110A and 110B then independently process this data as described above to determine whether a warning is needed based on currently available information. If so, those devices implement the warning directly, without need for further communication (with associated latency). On the other hand, in environments where processing power rather than network delay is the primary constraint, controller 120 may be configured to perform the processing described above instead. Those skilled in the art will recognize that known adaptive distributed processing techniques can be applied to tune such allocation over time to minimize the time needed to generate the warning.

In a different embodiment, vehicular controls are also applied based on prediction that a vehicle will be entering an intersection illegally. In one example, if a car is equipped with cruise control and is approaching an intersection at which the light will be red upon arrival, user device 110A interacts with the vehicle's control system 140 (either by an existing general purpose connection such as Bluetooth or by direct wired connection) and deactivates the cruise control as an early indication to the driver that slowing down will be necessary. In another example, the ABS system is activated to provide sensory indication through two or three quick automated brake "pumps" that slowing will be required. In a slightly more aggressive implementation, more significant automatic application of the brakes is made. In a further example, the user device interacts with the vehicle control system 140 to flash the vehicle's lights and sound the horn as a further warning. Some automobiles are equipped with cruise control features and braking systems that automatically become prepared to stop a car quickly when danger is detected (known variously as "active cruise control", braking assist or "adaptive brake assistant") and in such automobiles, the signal from user device 110A activates these systems before any on-board sensors (e.g., radar, lidar, sonar proximity systems) may recognize the need to do so. Those skilled in the art will recognize that such vehicular control may be applied not only to the vehicle about to enter the intersection illegally, but also to nearby vehicles (whether as warnings or countermeasures).

It should be noted that the discussion above has focused on traffic lights as the traffic controls, but the disclosure here applies to other types of traffic controls as well. For instance, some school areas have speed limits that change over the course of a day; some freeway entrances have metering lights that may be on or off depending on how much traffic is present. The disclosed systems and methods here can also be applied to static traffic controls, such as stop signs and railroad crossing signs. Some such controls are static in and of themselves but their applicability is not static. For instance, some intersections allow a right turning lane to continue without a stop except during rush hours. A different dynamic impact comes from the fact that certain vehicles are subject to certain controls while others are not—consider for instance that some vehicles are required to stop at railroad crossings while others are not.

As another example, historical data regarding particular user devices 110 and how often they are associated with certain driver behaviors can also be used to predict whether a vehicle is likely to run a red light. For instance, for user devices that are often involved in running red lights (as opposed to merely heavy braking and acceleration at controlled intersections, but no red light running), such instances are recorded and logged so that not merely the speed of a vehicle approaching an intersection, but the past history of associated user devices, factors into determination of when to issue, and when to escalate, the warnings described herein. In some embodiments, such information regarding driver aggressiveness is stored in the database 129 of controller 120. However, drivers may be reluctant to have information regarding their aggressiveness stored in a centralized database, so in other embodiments it is stored only locally in user device 110 and used to adjust warning thresholds locally at user device 110. Those skilled in the art will recognize other individualized factors (age, response time, driving record) that likewise can be used, locally or centrally, to make predictions more accurate while, to any degree desired, maintaining anonymity and protecting personally identifiable information from disclosure to law enforcement agencies or others. Again, driver-specific tuning of thresholds can be used not only for the vehicle about to enter an intersection illegally, but also for other nearby vehicles as well.

It should also be noted that the systems and methods discussed herein can readily be adapted to other useful functions, thus increasing the value of use of the system. In addition to safety measures, energy efficiency can also be enhanced using these systems and methods. For example, with user device 110A being connected to vehicle control system 140, it is a simple matter to automatically shut off a vehicle's engine if the user is approaching or already stopped at an intersection that will have a red light lasting for a duration above some threshold. Depending on the type of vehicle (e.g., fuel cell, hybrid gas-electric, diesel) the duration of a stop for which it will be beneficial from an environmental or engine life perspective to turn off the engine will differ, and the system described herein readily allows programmatic control to optimize among various such parameters. Even for static traffic controls such as stop signs, it may be advantageous in some environments to turn off a vehicle's engine as it approaches such a control, since the vehicle will be expected to be slowing and will not need power from the engine. Many modern automobiles are already configured to automatically turn off engines when stopped (with power being restored should the accelerator pedal be pressed) so in such an embodiment, the engine is simply turned off somewhat earlier than it would be without the knowledge that a traffic control is approaching. Similarly, externally detected presence of other hazards, such as a train that is traversing a railroad crossing, is usable in some embodiments to alter engine operation (e.g., turning the engine off) when a situation is detected in which it is clear the vehicle will need to be stopping. Similarly, other types of vehicle controls can be activated (or deactivated, as appropriate) based on such external situations that are detected as described herein. As one example, some vehicles have a special mode of operation when dangerous conditions are sensed (e.g., brake assist as mentioned above) and external detection of deteriorating weather conditions via information received from user device 110A in one embodiment causes such a mode of operation to be activated.

The present invention has been described in particular detail with respect to several possible embodiments. Those of skill in the art will appreciate that the invention may be practiced in other embodiments. The particular naming of the components, capitalization of terms, the attributes, data structures, or any other programming or structural aspect is not mandatory or significant, and the mechanisms that implement the invention or its features may have different names, formats, or protocols. Further, the system may be implemented via a combination of hardware and software, as described, or entirely in hardware elements. Also, the particular division of functionality between the various system components described herein is merely exemplary, and not mandatory; functions performed by a single system component may instead be performed by multiple components, and functions performed by multiple components may instead performed by a single component.

Some portions of above description present the features of the present invention in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "determining" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that various of the process steps and instructions disclosed herein could be embodied in software, firmware or hardware, and when embodied in software, could be downloaded to reside on and be operated from different platforms used by real time network operating systems.

The present invention also relates to an apparatus for performing the operations herein. This apparatus may be specially constructed for the required purposes, or it may comprise a general-purpose computer selectively activated or reconfigured by a computer program stored on a computer readable medium that can be accessed by the computer and run by a computer processor. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

In addition, the present invention is not described with reference to any particular programming language. It is appreciated that a variety of programming languages may be used to implement the teachings of the present invention as described herein, and any references to specific languages are provided for enablement and best mode of the present invention.

The present invention is well suited to a wide variety of computer network systems over numerous topologies. Within this field, the configuration and management of large networks comprise storage devices and computers that are communicatively coupled to dissimilar computers and storage devices over a network, such as the Internet.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention.

What is claimed is:

1. A safety system, comprising: a vehicle route subsystem configured to receive, via the Internet from a device within the vehicle, position data associated with the vehicle, and determine, based on the position data, a predicted time of arrival of a vehicle at a traffic control; a database geographically separated from both the vehicle and the traffic control and configured to store traffic control data; a traffic control interaction subsystem in operative communication with the database and the vehicle route subsystem, the traffic control interaction subsystem configured to predict a state of the traffic control at the time of arrival responsive to the traffic control data; and a user device interaction subsystem configured to generate a prediction that the vehicle is about to violate the traffic control based on a current dynamic of the vehicle, a current distance from the vehicle to the traffic control, and the predicted state of the traffic control at the time of arrival, the user device interaction subsystem further configured to provide a warning, via the Internet, at a device proximate the traffic control that the vehicle is about to violate the traffic control; wherein providing the warning is responsive to a driver-specific parameter that is based on historical data describing the driver's driving behavior.

2. A computer-implemented method for providing a warning that a vehicle is predicted to violate a traffic control, the computer-implemented method comprising: receiving, via the Internet from a user device within the vehicle, position data associated with the vehicle; determining, based on the position data, a predicted time of arrival of the vehicle at a traffic control; predicting a state of the traffic control at the predicted time of arrival responsive to traffic control data stored in a database that is geographically separated from both the vehicle and the traffic control; predicting that the vehicle is about to violate the traffic control based on a current dynamic of the vehicle, a current distance from the vehicle to the traffic control, and the state of the traffic control at the predicted time of arrival; and providing, via the Internet, a warning by a device proximate the traffic control that the vehicle is about to violate the traffic control, a level of the warning varying over time responsive to a certainty of the prediction that the vehicle is about to violate the traffic control; wherein providing the warning is responsive to a driver-specific parameter that is based on historical data describing the driver's driving behavior.

* * * * *